United States Patent [19]

Leifeld

[11] 3,997,928

[45] Dec. 21, 1976

[54] METHOD FOR THE TREATMENT OF TEXTILE, FLEECE AND SIMILAR WEBS

[75] Inventor: Ferdinand Leifeld, Kempen, Germany

[73] Assignee: Eduard Kusters, Krefeld-Forstwald, Germany

[22] Filed: Jan. 27, 1975

[21] Appl. No.: 545,345

[30] Foreign Application Priority Data

Jan. 26, 1974 Germany ..... 2403815

[52] U.S. Cl. ..... 8/149.1; 8/151; 68/5 D; 68/20; 68/62

[51] Int. Cl.[2] ..... D06B 1/06; D06B 15/04

[58] Field of Search ..... 68/5 D, 5 E, 9, 19.1, 68/20, 13 R, 62; 8/149.1, 151, 151.2; 26/2 R; 28/72 P, 74 P, 76 P

[56] References Cited

UNITED STATES PATENTS

| | | | |
|---|---|---|---|
| 2,785,042 | 3/1957 | Grajeck et al. | 8/149.1 X |
| 3,589,147 | 6/1971 | Price et al. | 68/20 X |
| 3,750,428 | 8/1973 | Bruckner | 68/20 X |
| 3,766,756 | 10/1973 | Farrar | 68/20 X |
| 3,776,004 | 12/1973 | Fleissner | 68/5 E |
| 3,864,079 | 2/1975 | Gregg | 8/151 |

*Primary Examiner*—Philip R. Coe
*Attorney, Agent, or Firm*—Kenyon & Kenyon Reilly Carr & Chapin

[57] ABSTRACT

An improved method for the treatment of a web material such as a textile, fleece or similar web which is continuously moving and is patterned by means of printing, dyeing or the like and the pattern fixed with remaining patterning and treating agents washed out thereafter, additional steps in which, after the fixing treatment and before the washing step, the web of material has applied to it a quantity of a rinsing liquid just sufficient to moisten the fibers of the web at their surface and the rinsing liquid immediately thereafter suctioned away are included in the process. Also disclosed is apparatus for carrying out the process.

10 Claims, 2 Drawing Figures

METHOD FOR THE TREATMENT OF TEXTILE, FLEECE AND SIMILAR WEBS

The invention relates to a method for the treatment of textile, fleece and similar webs, in which the continuously moving web is provided with a pattern by printing, dyeing or the like, in which the pattern is fixed and in which remaining patterning or treating agents are washed out.

The above described method is being carried out in practically every textile printing or dyeing procedure. Dye portions which have not attached themselves to the fibers as well as thickening and wetting agents and other textile auxiliaries of different kinds, which are intended to improve the dyeing or printing procedure, and may have been contained in the dyeing fluid or may have been applied to the web separately, are being removed from the web again in a following washing step. Depending on the structure of the web, particularly when the material is voluminous as carpets, the web is loaded with considerable quantities of substances to be removed, which can only be brought away in a correspondingly thorough washing step. In any case there is a need for large quantities of water, the temperature of which has to be elevated in some cases, so that there is a corresponding consumption of thermal energy.

Another problem encountered when patterning textile webs by printing or in a similar procedure consists in that when using relatively concentrated dyeing liquids which are particularly necessary for the more voluminous materials, there is a certain danger that an unintended attaching or bleeding of the dye into nonedyed or differently dyed zone takes place, when or shortly before the web enters the washing liquid. By this the sharpness of the contours and the fineness of the pattern are impaired. It is the object of the invention to free the web, already before the washing step commences, from a portion of the patterning or treating substances, which have remained on the web after the fixing step.

To solve this problem the web is after the fixing treatment and before the washing step loaded with a quantify of rinsing liquid, which is just sufficient to moisten the fibres of the web at their surface, and the rinsing liquid is sucked away immediately afterwards.

The moistening is only to be effected to such a degree that everywhere on the web, where dyeing liquid and other treating liquids have been deposited, a continuous film of the rinsing liquid established. The quantity of rinsing liquid necessary for this depends on the material of the web. For carpets, for which the invention is preferably used, 300 percent of rinsing liquid, related to the weight of per square unit of the dye carpet, will be sufficient average qualities. However, there are also carpet sorts with a particularly thick pile, which need up to 600 percent rinsing liquid to be applied. Immediately after application, i.e. before any reaction of the rinsing liquid with the web will be perceptible in the pattern, especially before in printed webs a bleeding of the printing outlines will take place, the applied rinsing liquid is sucked away again. It has been found that during this suction step a very large part of the substances to be removed (usually by the washing step) are being dragged along. The applied rinsing liquid partly effects a decrease of viscosity of the patterning or treating agents on the web and thus makes them more easily transportable by suction. Partly it causes a purely mechanical dragging away of the substances to be removed. This all is done with a quantity of rinsing liquid, which is just sufficient for a surfacewise moistening of the fibres, which is much less than the normally necessary quantities of washing liquid. The web being freed already from a large part of a substances to be removed, the actual washing step is considerably relieved, so that washing liquid, energy for its heating and efforts for its cleaning may be saved.

Normally, of course, the rinsing liquid as well as the washing liquid will be water. Nevertheless, the invention is principally not limited to water, but will also be applicable in the field of dyeing with other solvents. It is also not necessary that the rinsing and washing liquids are the same.

Some effect due to the invention is obtained at every temperature of the rinsing liquid. It is recommended, however, that the rinsing liquid is brought onto the web in a hot state, because the decrease in viscosity and the rinsing effectivity are then especially intensified.

The preferred field of use of the invention are pile fabrics, especially carpets, because the washing problems are here particularly urgent, due to the voluminosity of these materials. It has turned out that, depending on from which side the moistening or the suction respectively are effected in relation to the pile side of the web, there show up different grades of success. The following table has been established (for permeable qualities):

| Application of the rinsing liquid: | Direction of suction: | Result: |
|---|---|---|
| pile upside | | |
| from above | upwards | very good |
| from above | downwards | poor |
| from below | upwards | good |
| from below | downwards | very poor |
| pile downside | | |
| from above | upwards | poor |
| from above | downwards | very good |
| from below | downwards | good |
| from below | upwards | very poor |

The preferred way to proceed with pile webs consequently consists in that the suction is being effected from the pile side.

The results with this method are in any case very good, may the rinsing liquid have also applied from the pile side or from the backside.

An apparatus for carring out the method, which in the usual way comprises a patterning means, which is followed in the direction of the movement of the web by a fixing means, which in turn is followed by a washing means, is characterized in that between the fixing means and the washing means there are disposed a means for applying the rinsing liquid on the web over its width and at least in the same height as viewed in the direction of movement of the web, a suction means, which sucks away the applied rinsing liquid over the width of the web.

The distance between the application means and the suction means is to be just so great that a continuous film may be built up. The distance correspondingly much depends from the web material and its speed of movement. In certain cases the apparatus may already function when the application of the rinsing liquid and the suction take place in the same height as viewed in the direction of the movement of the web. Normally there will have to be a maybe small distance, especially when the rinsing liquid is to be sucked through the web. In the continuous dyeing or patterning of carpets, for example, working speeds of 5 to 8 meters per minute are usual. For such uses the distance may be about half a meter.

Any sort of application means for the rinsing liquid may be used, as long as it is able to apply an uniformly wetting film. There may be taken into regard application apparatuses having a trough extending over the width of the web and containing a rotating roller, from which a doctor blade downwardly inclined to the web takes off a liquid film and lets it run down from its lower edge onto the web. The web is being coated with an uniform veil of liquid by pouring. Yet also spraying devices are appropriate.

Also the suction means may be of different kinds. A usual suction roller will do.

It has turned out that a suction device particularly useful for carpets is a fixed suction chamber with a suction slot transverse to the web and with a sieve band between the suction slot and the web, which is endlessly rotating around the suction chamber and is advancing together with the web in the zone of the suction slot. Near the suction slot, the web is supported by the sieve band, so that is has not to be drawn over the suction slot against the forces of the vacuum. This is particularly important for the preferred embodiment of the invention, in which the suction takes place from the pile side of a pile web, because then a damage to the pile during the passage over the suction slot is prevented.

In order to further prevent smearing and blurring and similar deterioriations of the pattern by the sieve band engaging the just fixed web, there are provided, conforming to a development of the invention, guides for the sieve band and the web, which guarantee that the web does not come into engagement with the sieve band but shortly before the suction slot.

The drawing shows preferred embodiments of the invention, which will now be described in detail.

Figure 1:
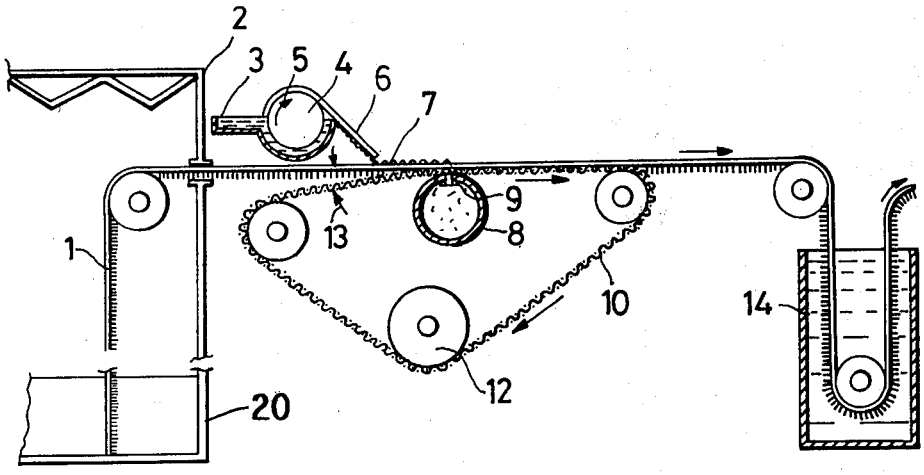
FIG. 1 shows a first embodiment, in which the web is guided over a suction slot with the pile downwards.

In FIG. 1 the numeral 1 generally designates a carpet web of medium weight, i.e. about 1 kilogram per square meter.

The web 1 is leaving a fixing means 2, in this case a steam chamber, which follows a patterning means 20, and is outside the fixing means 2 running about horizontally with the pile downwards. The support means necessary for guiding the web, as guide rollers and similar devices, have not been illustrated.

Immediately behind the fixing means there is disposed above the web 1 a trough 3 extending across the width of the web 1 and filled with water as a rinsing liquid. In the trough 3 a roller 4 also extending across the width of the web 1 rotates in the direction of arrow 5. The roller 4 is dipping into the water with its lower part and carries with it a film of water on the surface. This film of water is wiped off the roller 4 by a doctor blade 6, which is inclined downwards against the web 1. The water film is running down from the lower edge of the doctor blade 6 onto the backside of the web 1 as a veil 7, which is uniform over the width of the web 1.

The water then sinks into the back of the web 1. There are applied about 300 percent of water, related to the weight per square unit of the dry material, i.e. about 3 kilograms per square meter. This quantity is just sufficient to moisten the fibres of web 1 completely on their surface. The quantity of water to be applied varies considerably, depending on the kind of web material to be treated.

The applied water enters the web 1 more and more. Not far behind the impinging zone of veil 7 of web 1 (in the embodiment shown about half a meter behind) there is provided on the pile side of web 1 a suction tube or chamber 8, which is disposed transversely to the web and has a suction slot 9 extending across the width of the web 1.

In the suction tube 8 there is maintained a vacuum, and an essential quantity of the water applied to the web 1 is being sucked away through web 1 from its pile side. By this a large portion of the unfixed dye remaining on the web 1 and of the other auxiliaries applied to web 1 or carried along are also sucked away.

In order to prevent damages to the pile of web 1 during the passage over the suction slot 9 by its edges, a rotating sieve band 10 is disposed below web 1 and between suction slot 9 and the pile. The web 1 engages the supporting sieve band 10 before it reaches the suction slot 9. Direct friction contact of the pile side of web 1 at the suction slot 9 is thus prevented. Particularly printed webs have to be protected, so that by premature contact of the sieve band 10 with the web 1 loaded with excess dye no smearing or other deteriorations of the pattern occur. For this purpose the rotating sieve band 10 is guide by an appropriate arrangement of guide rollers 12 before it passes the suction slot 9. The sieve band 10 thus not engages the web 1 but immediately before it arrives at the suction slot 9.

After passing the suction slot 9 web 1, that has now already been freed to a far extent from carried along substances, which have to be removed, enters a washing apparatus 14. This washing apparatus 14 is essentially relieved from its original function and may be dimensioned essentially smaller than previously.

Figure 2:
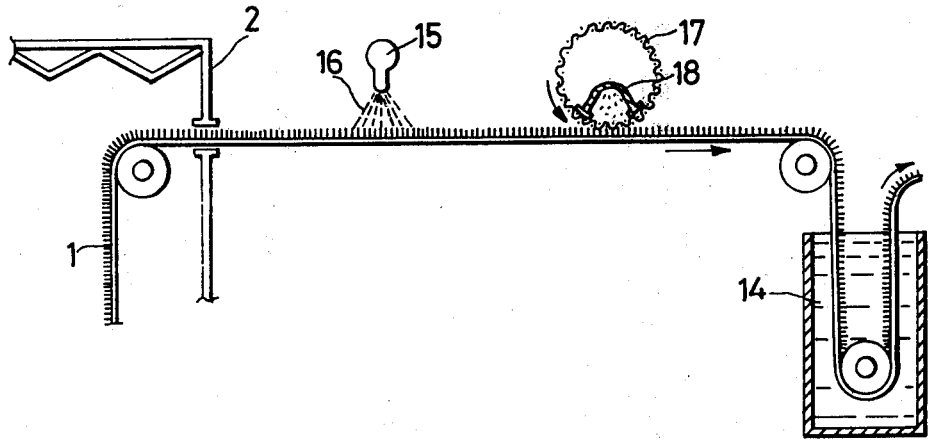
FIG. 2 shows another embodiment, in which the web advances under a suction roller with the pile upwards.

The embodiment conforming to FIG. 2 is different from that of FIG. 1 in that the carpet web 1, after leaving the fixing means 2, is guided so that the pile is upwards. The application of the water is effected by a spraying tube 15, the nozzles of which are so directed that there results a spraying zone 16 uniform over the width of web 1.

The suction means in this embodiment is constituted by a rotating sieve suction drum 17, in the interior of which is arranged a suction channel 18, which is open against the inside surface of the suction drum 17. In a zone given by the opening angle the suction drum 17 sucks away the water applied by the spraying tube 15 from web 1 and drags along a great portion of the substances to be removed.

In FIG. 2 the application of the water serving as rinsing liquid and the suction are effected from above, i.e. from the pile side. Such an arrangement is provided for materials which are not permeable, for instance for carpets with impermeable backsides. The embodiment according to FIG. 1, in which the application of the water serving as rinsing liquid is effected from above, i.e. from the backside of the carpet web 1, while the suction is done from the pile side, i.e. from below, needs a web which is permeable for water.

With regard to the dimensioning of the quantity of water to be applied and of the distance between the application means and the suction means in FIG. 2 the same points of view are valid as in FIG. 1. In both cases it is recommended, to increase the temperature of the water serving as rinsing liquid, to 80° to 90° centigrade, in order to improve the rinsing effectivity.

Although specific embodiments have been illustrated and described, it will be obvious to those skilled in the art that various modifications may be made without departing from the spirit of the invention which is intended to be limited solely by the appended claims.

What is claimed is:

1. In a method for the treatment of a web of material such as a textile or fleece material which comprises the steps of:

a. continuously moving the web;
b. patterning the web;
c. fixing the pattern; and
d. washing out the remaining patterning treating agents the improvement comprising performing, after fixing and before washing, the steps of:
e. directing onto the surface of the web from an external source a quantity of rinsing liquid which is just sufficient to moisten the surface of fibers of the web; and
f. immediately thereafter suctioning the rinsing liquid away from the web.

2. The method of claim 1 wherein the rinsing liquid is applied to the web while said liquid is hot.

3. The method according to claim 1 wherein the web is a web having a pile and wherein said rinsing liquid is sucked away from the pile side.

4. Apparatus for the treatment of a web of material such as a textile or fleece comprising:

a. means for continuously moving the web of material;
b. means for patterning the moving web of material;
c. means following said patterning means for fixing the pattern applied to the web; and
d. means for washing said web following said means for fixing wherein the improvement comprises, disposed between said means for fixing and means for washing in the direction of travel;
e. means for directing a rinsing liquid from an external source onto the surface of and across the width of the web of material in an amount which is just sufficient to moisten the surface of fibers of the web; and
f. suction means immediately behind said means for applying rinsing liquid in the direction of travel for sucking away said rinsing liquid across the width of said web.

5. Apparatus according to claim 4 wherein said suction means is placed a distance from said means for applying rinsing liquid which is the minimum distance permitting a continuous film to build up on said web.

6. Apparatus according to claim 4 wherein said suction means is placed at essentially the same position along said web as said means for applying rinsing liquid.

7. Apparatus according to claim 4 wherein said suction means are placed at a short distance from said means for applying rinsing liquid in the direction of movement of said web.

8. Apparatus according to claim 4 wherein said web is a web having a pile and wherein said suction means are disposed on the pile side of said web.

9. Apparatus according to claim 4 wherein said suction means comprises a fixed suction chamber having a suction slot extending transversely across said web and further including, between said web and said suction slot, a sieve band supported for endless rotation about said suction chamber, said sieve band being arranged to come into engagement with said web in the area of said suction chamber and being carried along with said continuously moving web thereafter, said sieve thereby endlessly rotating about said suction chamber.

10. Apparatus according to claim 9 and further including means for guiding said web and said sieve band so as to prevent engagement of said sieve band with said web until they reach the immediate area of said suction slot.

* * * * *